US006168128B1

(12) United States Patent
King

(10) Patent No.: US 6,168,128 B1
(45) Date of Patent: Jan. 2, 2001

(54) PATIO TABLE TIE-DOWN ASSEMBLY

(76) Inventor: Stella J. King, 3 Big Oak Rd., Dillsburg, PA (US) 17019-9122

( * ) Notice: Under 35 U.S.C. 154(b), the term of this patent shall be extended for 0 days.

(21) Appl. No.: 09/258,328

(22) Filed: Feb. 25, 1999

(51) Int. Cl.[7] ..... B65D 63/00
(52) U.S. Cl. ..... 248/499; 248/500; 248/505
(58) Field of Search ..... 248/499, 500, 248/501, 502, 505, 506, 680, 681; 410/96, 97

(56) References Cited

U.S. PATENT DOCUMENTS 1,321,742 * 11/1919 Hendricks ..... 248/505
2,372,967 * 4/1945 Martin ..... 410/97
4,582,287 * 4/1986 DeLeary ..... 248/519
4,659,122 * 4/1987 Miller ..... 292/262
4,712,162 * 12/1987 Quiogue ..... 248/505
5,431,365 * 7/1995 Hopkins ..... 248/683
5,564,610 * 10/1996 Barron ..... 224/268
5,673,464 * 10/1997 Whittaker ..... 24/301

* cited by examiner

*Primary Examiner*—Anita M. King
*Assistant Examiner*—Gwendolyn Baxter

(57) ABSTRACT

A table tie-down assembly is provided including a plurality of straps each having a pair of elongated side edges and a pair of short end edges. Each strap includes at least one aperture formed therein adjacent to the end edges such that the strap may be fastened to a recipient surface for tying down a table.

6 Claims, 2 Drawing Sheets

PATIO TABLE TIE-DOWN ASSEMBLY

BACKGROUND OF THE INVENTION

1. Field of the Invention

The present invention relates to tie-down devices and more particularly pertains to a new patio table tie-down assembly for securing a patio table to a recipient surface.

2. Description of the Prior Art

The use of tie-down devices is known in the prior art. More specifically, tie-down devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,894,365; U.S. Pat. No. 3,449,874; U.S. Pat. Des. 298,914; U.S. Pat. No. 3,937,436; U.S. Pat. No. 4,180,952; and U.S. Pat. No. 4,402,166.

In these respects, the patio table tie-down assembly according to the present invention substantially departs from the conventional concepts and designs of the prior art, and in so doing provides an apparatus primarily developed for the purpose of securing a patio table to a recipient surface.

SUMMARY OF THE INVENTION

In view of the foregoing disadvantages inherent in the known types of tie-down devices now present in the prior art, the present invention provides a new patio table tie-down assembly construction wherein the same can be utilized for securing a patio table to a recipient surface.

The general purpose of the present invention, which will be described subsequently in greater detail, is to provide a new patio table tie-down assembly apparatus and method which has many of the advantages of the tie-down devices mentioned heretofore and many novel features that result in a new patio table tie-down assembly which is not anticipated, rendered obvious, suggested, or even implied by any of the prior art tie-down devices, either alone or in any combination thereof.

To attain this, the present invention generally comprises a plurality of elongated, inelastic and flexible straps each having a generally rectangular configuration. Each strap is defined by a pair of elongated side edges and a pair of short end edges. Each strap includes a plurality of equally spaced, linearly aligned apertures formed therein adjacent to the end edges to define a closed central extent. As best shown in FIG. 2, the apertures are reinforced with grommets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new patio table tie-down assembly apparatus and method which has many of the advantages of the tie-down devices mentioned heretofore and many novel features that result in a new patio table tie-down assembly which is not anticipated, rendered obvious, suggested, or even implied by any of the prior art tie-down devices, either alone or in any combination thereof.

It is another object of the present invention to provide a new patio table tie-down assembly which may be easily and efficiently manufactured and marketed.

It is a further object of the present invention to provide a new patio table tie-down assembly which is of a durable and reliable construction.

An even further object of the present invention is to provide a new patio table tie-down assembly which is susceptible of a low cost of manufacture with regard to both materials and labor, and which accordingly is then susceptible of low prices of sale to the consuming public, thereby making such patio table tie-down assembly economically available to the buying public.

Still yet another object of the present invention is to provide a new patio table tie-down assembly which provides in the apparatuses and methods of the prior art some of the advantages thereof, while simultaneously overcoming some of the disadvantages normally associated therewith.

Still another object of the present invention is to provide a new patio table tie-down assembly for securing a patio table to a recipient surface.

Even still another object of the present invention is to provide a new patio table tie-down assembly that includes a plurality of straps each having a pair of elongated side edges and a pair of short end edges. Each strap includes at least one aperture formed therein adjacent to the end edges such that the strap may be fastened to a recipient surface for tying down a table.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
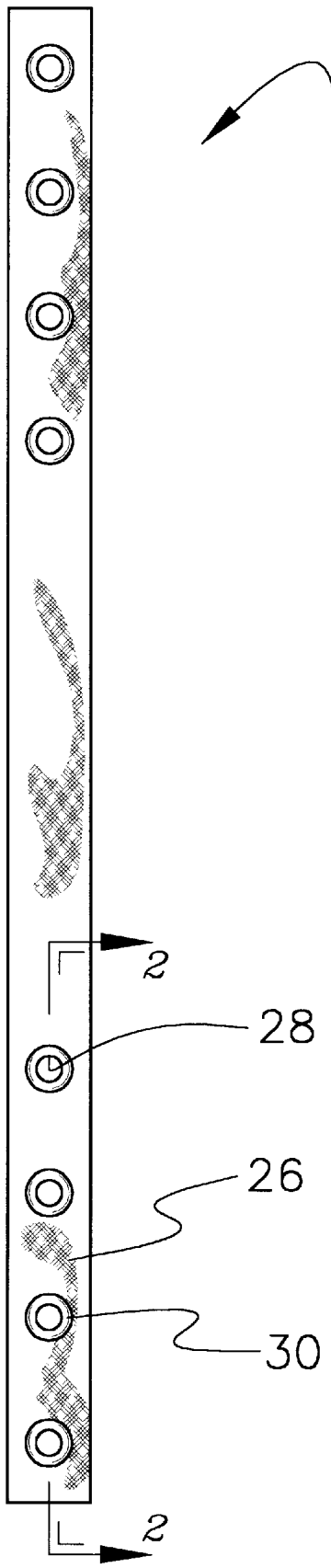
FIG. 1 is a top view of a new patio table tie-down assembly according to the present invention.

With reference now to the drawings, and in particular to FIGS. 1 through 4 thereof, a new patio table tie-down assembly embodying the principles and concepts of the present invention and generally designated by the reference numeral 10 will be described.

The present invention, designated as numeral 10, is adapted for use with a patio 12 including a recipient surface. The present invention is further adapted for use with a table 14 having a vertical post 16 including a top end with a substantially dome-shaped collapsible umbrella 17 mounted thereon. The post is also equipped with a central extent having a substantially disk-shaped resting surface 18 mounted thereon. The table further has four legs 20 each including a substantially horizontally oriented upper extent 22 with an inboard end coupled to a bottom end of the post. The upper extents of the legs each extend from the post in generally perpendicular relationship therewith. Each leg is further defined by a substantially vertically oriented lower extent 24 with a top end coupled to an outboard end of the upper extent of the corresponding leg. A lower end of the lower extent of each leg is adapted for resting on the recipient surface of patio.

Figure 2:
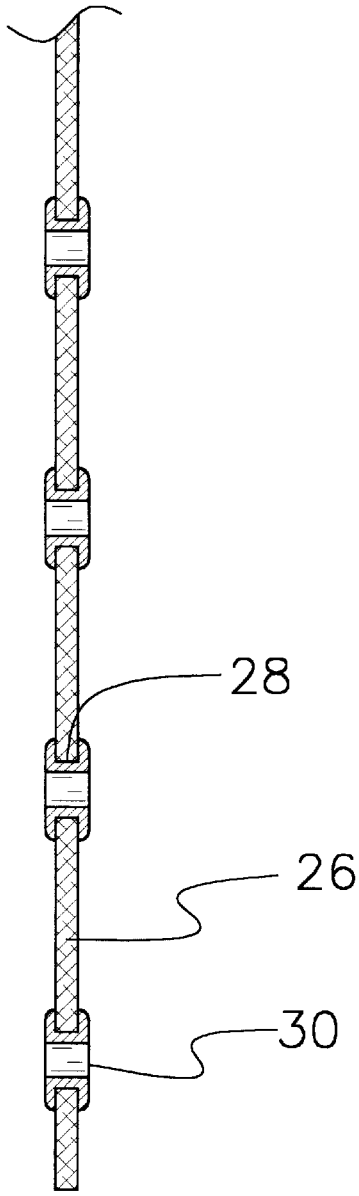
FIG. 2 is a side cross-sectional view of the present invention taken along line 2—2 shown in FIG. 1.
Figure 3:
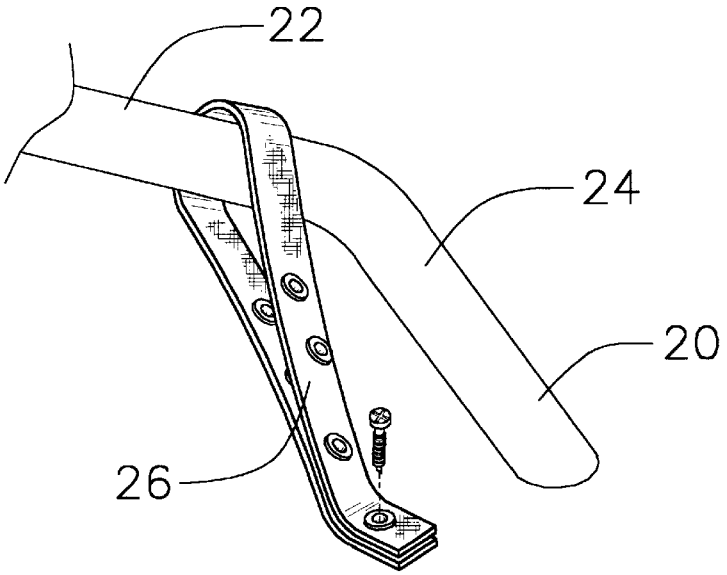
FIG. 3 is a perspective view of the present invention.
Figure 4:
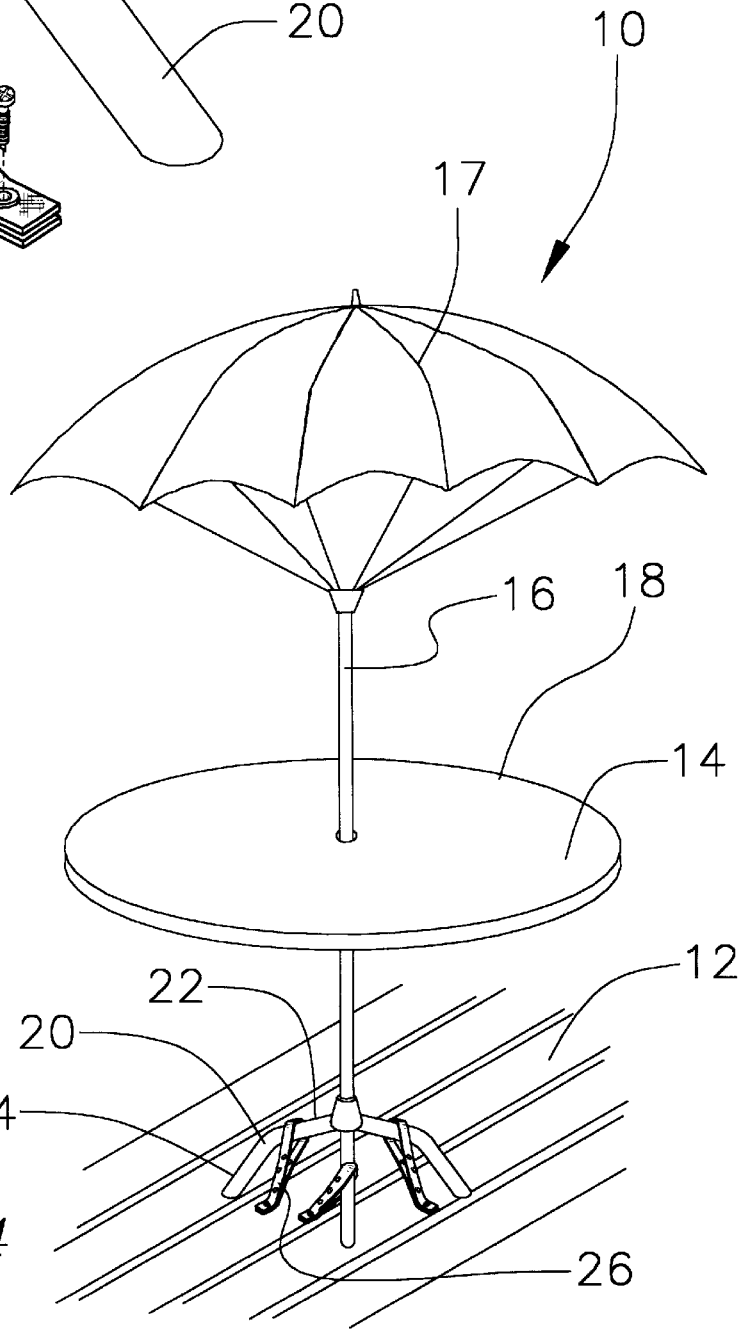
FIG. 4 is a side view of the present invention in use.

As shown in FIGS. 1 & 2, the present invention includes a plurality of elongated, inelastic and flexible straps 26 each having a generally rectangular configuration. Ideally, the straps each have a length of 12–18 inches and a width of 1 inch. Four straps are preferably provided for accommodating the four legs of the table. Each strap is defined by a pair of elongated side edges and a pair of short end edges. Each strap includes a plurality of equally spaced, linearly aligned apertures 28 formed therein adjacent to the end edges to define a closed central extent. As best shown in FIG. 2, the apertures are reinforced with grommets 30.

In use, the straps are each wrapped about the upper extent of one of the legs of the table. As such, the end edges of the strap depend downwardly. A fastener is passed through a pair of the apertures of the straps and further secured to the recipient surface for preventing movement of the table. Such fastener may comprise of a wood screw, cement screw, or stake depending on the nature of the recipient surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A table tie-down patio system comprising, in combination:

a patio including a recipient surface;

a table including vertical post including a top end with a substantially dome-shaped collapsible umbrella mounted thereon, a central extent with a substantially disk-shaped resting surface mounted thereon, and a bottom end, the table further including four legs each including a substantially horizontally oriented upper extent with an inboard end coupled to the bottom end of the post and extending therefrom in generally perpendicular relationship therewith and a substantially vertically oriented lower extent with a top end coupled to an outboard end of the upper extent of the corresponding leg and lower end for resting on the recipient surface of patio; and a plurality of elongated, inelastic and flexible straps each having a generally rectangular configuration with a pair of elongated side edges and a pair of short end edges located on end portions of the straps, each said strap including a plurality of equally spaced, linearly aligned apertures formed therein on the end portions between a central extent of the strap, wherein apertures are reinforced with grommets;

said straps each being wrapped about the upper extent of one of the legs of the table with the end edges of the strap depending downwardly, the end portions of each said strap being lapped together such that at least one of the apertures of one of the end portions is aligned with at least one of the apertures of the other of the end portion, a fastener passing through the aligned apertures of the end portions and the fastener being secured to the recipient surface for preventing movement of the table.

2. A table tie-down system comprising:

a table with a plurality of legs extending in a downward and outward direction for resting on a recipient surface;

a plurality, of straps each having a pair of elongated side edges, and a pair of short end edges, the straps each having opposite end portions, each of said straps having a portion wrapped about one of the legs of the table;

wherein each said strap includes at least two apertures formed therein, at least one of said apertures being located on each of the end portions adjacent to each of the end edges such that the end portions of the strap are adapted for being lapped together with one of the apertures of each end portion being in alignment with each other;

a fastener with an enlarged head portion and a relatively thinner shaft portion, the head portion of the fastener having a diameter larger than the diameter of the apertures such that the shaft portion of the fastener is movable through the aperture and the head portion is incapable of moving through the aperture for permitting fastening of the strap down by the fastener to a recipient surface for tying down a table.

3. The table tie-down assembly as set forth in claim 2 wherein the apertures are each reinforced with a grommet.

4. The table tie-down assembly as set forth in claim 2 wherein the straps are elongated, inelastic and flexible.

5. The table tie-down assembly as set forth in claim 2 wherein a plurality of the apertures are formed in each strap adjacent to each of the end edges thereof and in linear alignment.

6. A table tie-down patio system comprising:

a patio including a recipient surface;

a table including a substantially vertical post, and a plurality of legs, each leg including an upper extent with an inboard end coupled to the post and extending outward therefrom and a lower extent with a top end coupled to an outboard end of the upper extent of the corresponding leg and lower end for resting on the recipient surface of patio; and a plurality of elongated, inelastic and flexible straps each having a generally rectangular configuration with a pair of elongated side edges and a pair of short end edges located on end portions of the straps, each said strap including a plurality of equally spaced, linearly aligned apertures formed therein on the end portions between a central extent of the strap, wherein apertures are reinforced with grommets;

said straps each being wrapped about the upper extent of one of the legs of the table with the end edges of the strap depending downwardly, the end portions of each said strap being lapped together such that at least one of the apertures of one of the end portions is aligned with at least one of the apertures of the other of the end portion, a fastener passing through the aligned apertures of the end portions and the fastener being secured to the recipient surface for preventing movement of the table.

* * * * *